United States Patent [19]

Hamm

[11] Patent Number: 4,930,767

[45] Date of Patent: Jun. 5, 1990

[54] THERAPEUTIC DEVICE

[75] Inventor: Ronald L. Hamm, Peoria, Ill.

[73] Assignee: Ronald Hanna, Peoria, Ill. ; a part interest

[21] Appl. No.: 432,404

[22] Filed: Nov. 6, 1989

Related U.S. Application Data

[63] Continuation of Ser. No. 210,417, Jun. 21, 1988, abandoned.

[51] Int. Cl.[5] ..... A63B 23/04

[52] U.S. Cl. ..... 272/96; 272/139; 128/25 R

[58] Field of Search ..... 272/93, 135, 136, 137, 272/139, 119, 121, 143, 145, 96; 128/25 R, 25 B, 80 E, 80 F, 80 G, 80 D; 2/24

[56] References Cited

U.S. PATENT DOCUMENTS

| | | | |
|---|---|---|---|
| 140,237 | 6/1873 | Austin | 272/137 |
| 1,548,711 | 6/1925 | Cooper | 128/806 |
| 1,562,294 | 11/1925 | Cooper | 128/80 G |
| 1,633,641 | 3/1928 | Smallwood | 272/139 |
| 1,922,566 | 8/1933 | Bravel | 272/143 X |
| 2,467,943 | 4/1949 | Mikell | 272/96 |
| 3,295,517 | 1/1967 | Stevens | 128/80 G X |
| 3,670,339 | 6/1972 | Cooper et al. | 2/24 |
| 4,251,070 | 2/1981 | Leseberg | 272/143 X |
| 4,252,112 | 2/1981 | Joyce | 128/25 R X |
| 4,271,605 | 6/1981 | Raczku | 128/80 R |
| 4,294,238 | 10/1981 | Woodford | 128/80 G |
| 4,371,161 | 2/1983 | Williams | 272/96 |
| 4,459,980 | 7/1984 | Perser et al. | 128/80 E |
| 4,478,414 | 10/1984 | Molloy | 272/134 |
| 4,596,387 | 6/1986 | Roberts | 272/143 X |

FOREIGN PATENT DOCUMENTS

| | | | |
|---|---|---|---|
| 548527 | 11/1930 | Fed. Rep. of Germany | 128/80 E |
| 1087175 | 2/1955 | France | 128/80 J |

*Primary Examiner*—Richard J. Apley
*Assistant Examiner*—Howard Flaxman
*Attorney, Agent, or Firm*—Donald W. Hanson

[57] ABSTRACT

A therapeutic device for relieving tension or spasms in the lower back of the human body. The device comprises a foot engaging part having an upper portion and a lower portion forming a foot engaging enclosure, the lower portion of the foot engaging part forming an envelope and having an opening to allow the retention of an insert. The device further includes stretchable side members extending from opposing sides of the foot engaging part. The ends of the side members are joined to an upper strap portion which has sufficient length to allow placement of the strap portion around the leg of an individual user at an area above the knee of the user. The strap portion includes a fastener to fixedly secure the strap in that position about the knee.

8 Claims, 1 Drawing Sheet

THERAPEUTIC DEVICE

This application is a continuation of application Ser. No. 210,417, filed June 21, 1988, now abandoned.

BACKGROUND OF THE INVENTION

This invention is related to therapeutic devices and is more particularly concerned with therapeutic devices specifically designed to relieve lower back tension or spasms caused by the contraction of the muscles in the lumbar region of the lower back.

The most common disabling back condition may be described as spastic contractions in the lumbar spine area. Spastic contractions in this area result from attempts by the body to protect the area from further injury or to allow the endangered area to heal from an injury to the spine or to the muscles associated with the spine. The lumbar muscles contract, thereby immobilizing the lower back and making the spine more rigid in that area. This condition is often disabling because of pain associated with any attempted flexion or extension of the muscles in the area of contraction. Generally, a severe contraction or spasm occurs as a result of use of the lumbar muscles which have not been prepared by exercise for the use to which they are subjected. Once the body attempts to protect the area by contraction (spasm), a vicious cycle commences. The contraction causes irritation which in turn, promotes more contraction.

This contraction or spasm condition often manifests itself by a tightness of the muscles in the lumbar spine area evidenced by one or more of the following symptoms: (1) pain in the lower back without movement and aggravated by movement; (2) distension of the stomach caused by spasm in the back area; (3) body tilt usually associated with spasm only one side of the spine; and/or (4) pain in the thigh area of one or both legs resulting from strain to the ligaments and tendons connecting the leg and back muscles.

In the prior art, lower back tension or alternatively severe contractions (spasms) in the lumbar region of the lower back are treated with the use of medications such as muscle relaxing drugs, pain medications, either topical or internal, bed rest and/or exercise. The use of muscle relaxing drugs allows the muscles to stop contraction thereby relieving the irritation of the muscles, but is a slow means of treatment which may have undesirable side effects associated with the use of drugs, i.e., counter-indications with other medications, drowsiness, allergic reactions and the like. The topical or internal use of pain relieving medications lessens the pain associated with the contraction or spasm, but does not deal with the cause. The salutory effects of bed rest reside in the immobilization of the area thus reducing the irritation caused by the use of the muscles. Lastly, conventional forms of exercise are of little or no value in ameliorating the effects of the contraction or spasm, since the patient can not tolerate the pain associated with the conventional exercise regimens in the spasm or severe contraction condition.

SUMMARY OF THE INVENTION

Accordingly, it is an object of the present invention to provide a therapeutic device which may be used by a patient experiencing a spasm in the lower back region to facilitate extension of the muscles and ligaments from the ankle to the lower back. Extension of these muscles and ligaments promotes relaxation of the muscles in the lumbar region of the back and hence amelioration and/or elimination of the spasm condition by breaking the irritation/contraction cycle.

Another object of the invention is to provide a light, portable and inexpensive therapeutic device which can be self-administered and used anywhere to help prevent and/or arrest incipient spasms.

A further object of the invention is to provide an inexpensive, one-size fits all, therapeutic device for treatment of aggravated lower back contractions and or spasms which is drug free, safe and effective.

Briefly, the invention in its broadest aspect comprises a foot engaging means for placement under and around the foot of the patient in the ball to toe portion of the foot, elastic side members are fixedly attached and extend from the foot engaging means. The ends of the elastic side members opposite the foot engaging means are detachably joined and cooperate with an upper strap portion. The upper strap portion is of sufficient length to allow placement of the strap portion around the leg portion of the patient at an area above the knee and has means to secure the strap in that position. The means for detachably joining the upper strap portion and the elastic side members incorporates means to vary the distance between the foot engaging means and the upper strap means thereby allowing the therapeutic device to be used by any sized patient. Additionally, the foot engaging means incorporates an open-ended envelope to allow placement of a foam insert or pad to facilitate the comfort of the patient.

BRIEF DESCRIPTION OF THE DRAWING

The features and advantages of the invention will be apparent from the following description taken in connection with the accompanying drawing wherein.

DESCRIPTION OF THE PREFERRED EMBODIMENT

Figure 1:
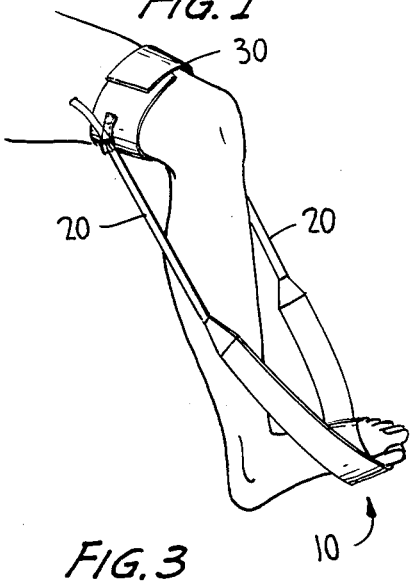
FIG. 1 is a perspective view of the invention operatively secured to the patient.

In one of the exemplary embodiments of the invention as disclosed in the drawing, specifically FIG. 1, the therapeutic device is shown to comprise a foot engaging means generally indicated at 10. The device further includes two stretchable side members 20 attached to the foot engaging means 10 as well as to a strap 30 adapted to be secured about the leg of the wearer at a position just above the knee.

Figure 6:
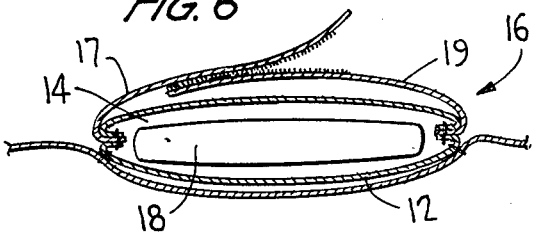
FIG. 6 is a front view of the foot engaging portion of the invention presenting an alternative foot securing means.
Figure 4:
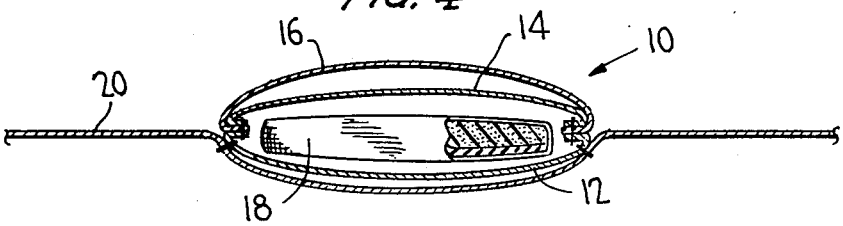
FIG. 4 is a front view of the foot engaging portion of the invention.
Figure 5:
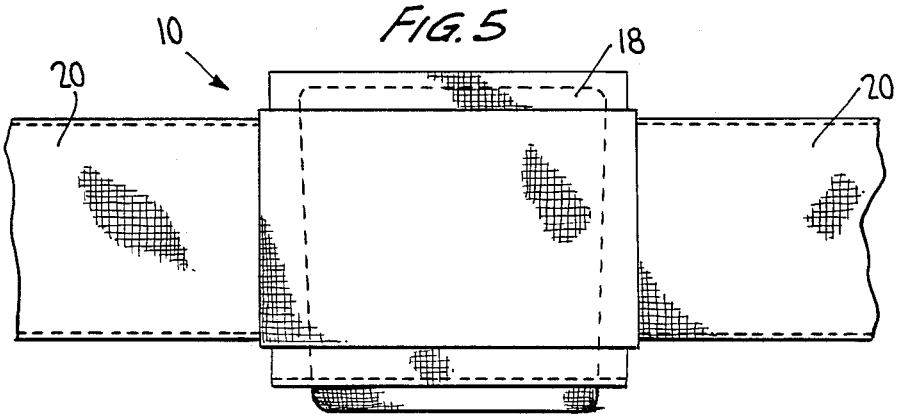
FIG. 5 is a top view of the foot engaging portion of the invention.

As is best shown in FIG. 4, the foot engaging means 10 of one embodiment of the invention comprises a substantially rectangular envelope of fabric webs 12 and 14 and being open at both ends. In this embodiment, the envelope is approximately 4½ inches by 5½ inches in dimension. Fabric webs 12 and 14 can be of an elastic fabric, or alternatively can be fabricated of cotton or like perspiration absorbant fabric. A foam pad or insert 18 of lesser dimension than envelope 10, generally about 4 inches by 5 inches, can be retained within the envelope formed from webs 12 and 14. Foam pad 18 provides for comfortable positioning of the ball and toe of the patient's foot when the therapeutic device is in use. As can also be seen from FIG. 4, upper member 16 may be comprised of a single member or alternatively, as shown in FIG. 6, may comprise two cooperating and attachable band portions 17 and 19. One end of each of the elastic band portions 17 and 19 are fixedly attached to the fabric envelope 10.

The opposing ends of each of the band portions 17 and 19 are provided with means to attach themselves to each other. The attachment means may comprise a cooperating buckle and belt arrangement or, preferably, a releasably self-holding fabric, e.g., a Velcro type fastener as shown in FIG. 6, either of which attachment means allow variance of the length of the member 16 to facilitate a firm and secure positioning of the patient's foot in the foot engaging means 10. The stretchable character of the member 16 or the cooperating band portions 17 and 19 facilitate a one-size accomodation of any sized foot.

Stretchable side members 20 are fixedly attached to the foot engaging means 10 at the opposing edges of the fabric envelope. In the preferred embodiment, the stretchable side members 20 are three to four inches in width and may be comprised of a double ply of elastic material. In another embodiment, the strechable side members 20 comprise a single, continuous piece of stretchable material such as elastic material, which is disposed below and affixed to the foot engaging means 10. The side members 20 are generally of equal dimension and in a preferred embodiment are approximately eight inches in length.

Figure 2:
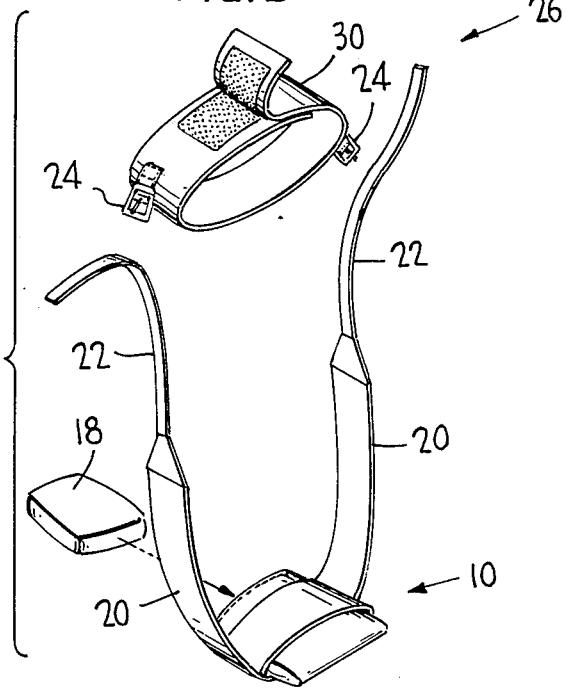
FIG. 2 is a perspective view of the invention presenting each of the functional elements of one embodiment of the invention.
Figure 3:
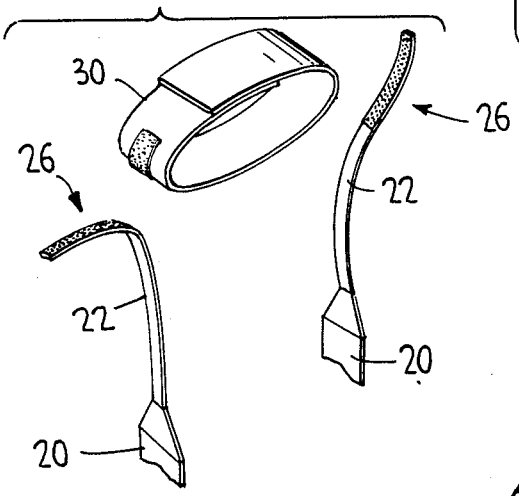
FIG. 3 is a detailed perspective view of the upper portion of the the invention presenting an alternative embodiment for a securing means.

The ends of the side members 20 distally opposite the foot engaging means 10 are provided with means to attach the side members 20 to securing strap 30. The attachment means generally depicted at 26 may comprise cooperating belt strips 22 and buckle 24 (FIG. 2), cooperating Velcro type fasteners disposed on belt strips 22 and securing strap 30 (FIG. 3), or like attachment means which allow variance of the distance between the foot engaging means 10 and the securing strap 30.

The securing strap 30, in a preferred embodiment, is comprised of a substantially rectangular fabric piece approximately twenty inches in length by three inches in width. The distal portions of the securing strap 30 are provided with a Velcro type fastener or like fastening means to firmly secure the strap around the leg of the patient in the area generally above the knee (FIG. 1). As previously stated, belt strips 22 are releasably attached to the securing strap 30 and cooperate with attachment means 26 to maintain elastic side members 20 disposed on opposing sides of the patient's leg between the ankle and upper calf.

In FIG. 1, the device is shown operatively in place on a patient for therapeutic purposes. As may be noted, the ball and toe portion of the patient's foot are placed between and retained by web 14, constituting the upper portion of the fabric envelope, and elastic member 16 or alternatively, cooperating strips 17 and 19 (FIG. 6) and firmly positioned by tightening the cooperating band portions 17 and 19. The securing strap 30 is placed around the patient's leg in the area above the knee. The device is adjusted by means of attachment means 26 to place the side members 20 under tension and thereby pulling the ball and toe portion of the foot upwardly and rotationally toward the patient's torso. In this dorsiflexing position of the patient's foot, the gastrocnemius or calf muscle, the Achilles tendon, the gluteal muscle and the hamstring muscle of the patient are extended and stretched. This static stretched dorsiflexing position tends to relieve the pressure and tension in the lower or lumbar region of the back thereby promoting relaxation of the muscles in the lumbar region.

Use of this therapeutic device is an inexpensive and portable alternative to pelvic traction. The degree of dorsiflexing exerted by tensioning of the elastic side members 20 is dependant primarily upon the discomforture caused to the patient. Generally, the greater the flexion, the greater the consequent stretching of the ligaments and muscles of the leg and hence promotion of relaxation in the lumbar region. In most instances, the use of the device is intended for intermittant periods. The tenure of such intermittant use or protocol for application is largely dependent upon the severity of the symptoms and may vary from minutes to hours. As will be appreciated, this is a static treatment and is not normally intended for ambulatory use.

While there has been shown and described what is considered to be the preferred embodiments of the present invention, it will be apparent to those skilled in the art that various changes and modifications may be made without departing from the invention as defined in the appended claims.

I claim:

1. A therapeutic device for use on the lower leg of a human wearer so as to be attached to both the foot and about a portion above the calf and the knee of the leg, the therapeutic device comprising a foot engaging means having an upper portion and a lower portion both of fabric webs forming a foot engaging enclosure adapted to extend about and retain the ball of the foot; the lower portion of the foot engaging means forming an envelope and having an opening to allow the retention of an insert; an insert within the envelope; two stretchable side members of elastic material attached to said foot engaging means for extending from opposing sides of said foot engaging means along opposing sides of the calf of the wearer; the upper ends of said side members being joined to an upper strap portion by means which allow the side members to be selectively adjustable in length from the foot engaging means, said upper strap portion having sufficient length to allow placement of the strap portion around the leg of an individual user at an area just above the knee of the said user, and having means to fixedly secure the strap in that position around the leg.

2. The therapeutic device of claim 1 wherein the said upper portion of the said foot engaging means is comprised of two cooperating, attachable members.

3. The therapeutic device of claim 1 wherein the stretchable side members comprise a singular stretchable member which extends about the lower portion of the foot engaging means.

4. The therapeutic device of claim 1 wherein said insert includes a foam pad.

5. The therapeutic device of claim 1 wherein each side member includes two belt strips and the means for joining the side members to the upper strap portion comprise a second strip having means affixed to the upper strap portion cooperating buckle disposed on a first belt strip and cooperating with the buckle to secure the first belt strip at a fixed length to the second strip.

6. The therapeutic device of claim 1 wherein the side members each include a belt strip and the means for attaching the side members to the upper strap portion comprise portions of each said belt strip having releasably self-holding fabric means confronting and facially opposing releasably self-holding fabric means disposed on the upper strap portion to allow adjustment of the length of said side members.

7. The therapeutic device of claim 1 wherein the upper strap portion is provided with means to adjustably connect the opposing ends of the said upper strap portion.

8. The therapeutic device of claim 7 wherein the means to adjustably connect the opposing ends of the said upper strap portion comprise releasably, self-holding fabric portions disposed on the opposing ends of the upper strap portion.

* * * * *